US011186417B2

(12) United States Patent
Brown

(10) Patent No.: US 11,186,417 B2
(45) Date of Patent: Nov. 30, 2021

(54) STORAGE CONTAINER

(71) Applicant: Leon Brown, London (GB)

(72) Inventor: Leon Brown, London (GB)

( * ) Notice: Subject to any disclaimer, the term of this patent is extended or adjusted under 35 U.S.C. 154(b) by 143 days.

(21) Appl. No.: 16/256,986

(22) Filed: Jan. 24, 2019

(65) Prior Publication Data

US 2019/0225392 A1 Jul. 25, 2019

(30) Foreign Application Priority Data

Jan. 25, 2018 (GB) ..... 1801221

(51) Int. Cl.
*B65D 51/24* (2006.01)
*B65D 6/06* (2006.01)
*A47C 13/00* (2006.01)

(52) U.S. Cl.
CPC ..... *B65D 51/24* (2013.01); *B65D 7/10* (2013.01); *B65D 9/08* (2013.01); *B65D 11/12* (2013.01); *A47C 13/00* (2013.01)

(58) Field of Classification Search
CPC ..... B65D 51/24; B65D 11/12; B65D 5/12; B65D 5/16; B65D 5/38; B65D 5/52; B65D 5/5206; B65D 5/68; B65D 5/0281; B65D 5/003; B65D 5/328; B65D 5/327; B65D 5/325; B65D 5/324; B65D 5/322; B65D 5/321; B65D 5/32; B65D 5/66; B65D 5/6617; B65D 5/6623; B65D 7/10
USPC ..... 206/736, 746, 751, 45.2, 45.21, 45.23, 206/45.28, 774; 220/212
See application file for complete search history.

(56) References Cited

U.S. PATENT DOCUMENTS 1,357,519 A * 11/1920 Russell ..... B65D 5/68 229/125.32
2,885,137 A * 5/1959 Reynolds ..... B65D 5/68 229/125.19
3,521,748 A * 7/1970 Layne, Sr. ..... B65D 5/0005 206/451
4,114,754 A 9/1978 Aley
4,645,275 A 2/1987 Pucci
4,697,699 A * 10/1987 Schneider ..... B65D 19/20 108/51.3
5,447,225 A * 9/1995 Gunn ..... B65D 5/2047 229/125.32

(Continued)

FOREIGN PATENT DOCUMENTS

GB 271607 A 6/1927
GB 294776 A 8/1928

(Continued)

*Primary Examiner* — Robert Poon
(74) *Attorney, Agent, or Firm* — Seed IP Law Group LLP

(57) ABSTRACT

A box with a lid having first and second opposed pairs of downwardly projecting legs which partially overlie the sides of the box to close the same. The length of the first pair of downwardly projecting legs is less than the length of the second pair of downwardly projecting legs. A generally horizontal ledge is formed in each side of the box with the ledges of two opposed sides of the box located at one level below the lid and those of the other opposed sides at a different level below the lid. In use, the first and second pairs of legs can either be supported on either one or the other pair of opposed ledges to vary the height of the lid above ground level. Also, the lid can be removed from the box to define a stool or support surface.

10 Claims, 3 Drawing Sheets

(56) References Cited

U.S. PATENT DOCUMENTS

| | | | | |
|---|---|---|---|---|
| 6,832,683 | B2 * | 12/2004 | Boriani | B65D 5/5445 206/273 |
| 8,418,854 | B2 * | 4/2013 | Zimmermann | B65D 5/321 206/775 |
| 2001/0052480 | A1 * | 12/2001 | Kawaguchi | B65D 5/543 206/736 |
| 2005/0230464 | A1 * | 10/2005 | Riedi | B65D 5/16 229/122 |
| 2006/0213958 | A1 * | 9/2006 | Valenzuela | B65D 5/22 229/120 |
| 2006/0283722 | A1 * | 12/2006 | Lutkauskas | B65D 5/68 206/45.28 |
| 2007/0090015 | A1 * | 4/2007 | Chandaria | B65D 5/5038 206/736 |
| 2012/0138607 | A1 * | 6/2012 | Mattox | B65D 21/086 220/8 |
| 2014/0144808 | A1 * | 5/2014 | Anderson | B65D 5/68 206/736 |
| 2015/0114881 | A1 * | 4/2015 | Snyder | B65D 5/5405 206/774 |
| 2015/0321832 | A1 * | 11/2015 | Bankowski | B65D 85/345 206/423 |
| 2016/0152375 | A1 * | 6/2016 | Chen | B65D 5/30 229/150 |
| 2019/0322412 | A1 * | 10/2019 | Couture | B31B 50/624 |

FOREIGN PATENT DOCUMENTS

| | | |
|---|---|---|
| GB | 2 084 443 A | 4/1982 |
| GB | 2 319 015 A | 5/1998 |

* cited by examiner

STORAGE CONTAINER

BACKGROUND

Technical Field

This invention relates to storage containers. More especially the invention relates to a storage container having a lid, the container and the lid being shaped and dimensioned to provide selectively in addition to a storage facility, one or more work surfaces, a stool and/or a stand for supporting the storage container or other objects.

Description of the Related Art

GB2319015 discloses a combined box and support stand/lid. The lid includes legs which are housed within discrete internal sections of the box when the lid is positioned to close the box and which when the lid is removed from the box define the legs of a support stand whose surface is the box lid. Whereas this combined box and support stand/lid has proved to be successful, in use the discrete internal sections reduce the internal volume of the box and the height of the stand remains fixed at one level.

The present invention provides an improved combined box and support stand/lid to that disclosed in my earlier patent. In particular, storage containers in accordance with the present invention have the added advantages that the lid is designed to be a stool when removed from the box and that the combined height of the lid and box when assembled can be set at one of several different levels.

BRIEF SUMMARY

In a first aspect, the invention provides a box having a base, at least one side wall and a cover, the cover having an upper surface bordered by two opposed pairs of downwardly projecting side members, the length of the side members of one such pair being less than that of the other pair of said members, a ledge formed in each of four side faces of the box with the ledges of two opposite side faces located at a first distance below the lid and the ledges of the other two opposed side faces located at a lesser distance below the lid, the arrangement being such that when removed from the box the cover can be employed as a stool or support surface with the lower edges of said other pair of downwardly projecting side faces defining ground engaging feet for the stool or support surface.

The box may be of circular, ovoid, square, rectangular or like cross-section.

The box cover may comprise a single lid which extends over substantially the entire upper surface of the box.

The lower edge of each of said other pair of downwardly projecting side members is preferably formed with two outer generally horizontal ground engaging sections which border a raised non-ground engaging central section.

Each raised non-ground engaging central section is preferably curvilinear. The central section may alternatively be other than curvilinear.

The box may include a generally flat lid which locates on the open top of the box and below the cover. The flat lid maybe attached to the box by one or more hinges.

In a preferred embodiment the box has four side walls on which the lid can be supported, opposed pairs of side walls being of equal or different length. Thus, in this arrangement the box could be either square or rectangular in cross section.

In an alternative embodiment, the box is of circular or oval construction.

In another arrangement, the box has more than four side walls; thus in cross section the box could, for example, be octagonal.

Wheels may be secured to the underside of the base to enable the box to be more easily transported from one location to another location. Additionally or alternatively one or more handles may be secured to one or more sides of the box to assist transport of the box. If provided, the or each handle may be extendable.

In a still further embodiment, the box may form part of a trailer connectable to a vehicle for transport between different locations.

The or each side wall and/or lid may be produced from a relatively rigid material such as wood, plastics or metal.

In another aspect, the invention provides a square or circular box including a cover formed with first and second opposed pairs of downwardly projecting members which partially overlie the sides of the box when the cover is located over the open top of the box to close the same, the length of said first pair of downwardly projecting members being less than the length of said second pair, a generally horizontal ledge formed in each of two opposed sides of the box with the ledges of two opposed sides of the box located at one level below the lid and those of the other opposed sides at a different level below the lid, the arrangement being such that, in use, the first and second pairs of legs can either be supported on one or the other pair of opposed ledges to vary the height of the cover above ground level, and such that the cover can be removed from the box to define a stool or support surface with the lower edges of the cover in contact with the ground.

In another aspect, the invention provides a generally square or circular box whose side members include generally horizontal ridges dimensioned to support downwardly extending legs of a box cover, the ridges located on one side of the box being at a different height above the base of the box to those located on the other side of the box, whereby the height of the cover above ground level can be changed by turning the cover through ninety degrees and wherein the cover, when removed from the box, can be employed as a stool or table surface.

BRIEF DESCRIPTION OF THE SEVERAL VIEWS OF THE DRAWINGS

The invention will now be described by way of example only with reference to the accompanying diagrammatic drawings in which.

DETAILED DESCRIPTION

Figure 1:
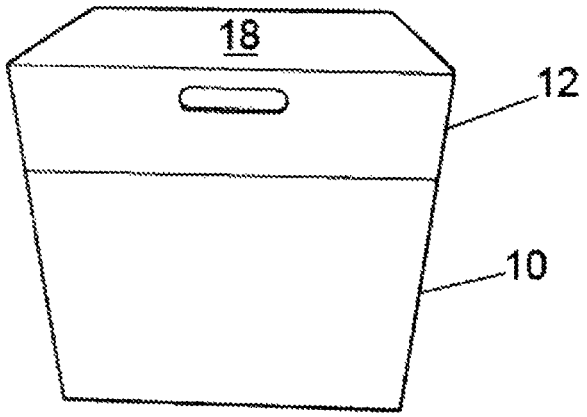
FIG. 1 is an isometric view of a first box in accordance with the invention.

The box illustrated in FIGS. 1 to 5 comprises an open-topped trunk section 10 closable by a cover 12. The trunk section 10 of the box is of rectangular cross-section and comprises opposed pairs of side walls 14 and 16 and a base.

The cover has a generally horizontal upper surface 18 bordered by downwardly extended sides 20 and 22. The sides 20 extend downwardly from opposite sides of the cover and are each of a length which corresponds to approximately one third of the height of the trunk section 10. The lower edge 24 of each side 20 is generally horizontal and extends across the full width of the respective side 20.

The length of each of the sides 22 is the same and equates to approximately two thirds of the height of the trunk. The lower edge 25 of each side 22 comprises a curvilinear central section 26 bordered by two generally horizontal sections 28.

Thus, the side walls 14 are mirror images of one other and, likewise, the side walls 16 are also mirror images of one another.

The quoted lengths are given simply by way of example and it is to be understood that other lengths may be adopted. In an embodiment, it is preferable that the lengths of the sides 20 and 22 are different.

Below the level of the sides 20, the width of each side 22 is reduced, a curvilinear corner 30 being provided at each such width reduction.

The side walls 14 of the trunk section 10 each include a generally horizontal ledge 32 whose width and length equate to those of the edges of the sides 20 of the cover 12. Similarly, each side wall 16 includes a ledge 34 including sides 36 and central section 38 whose width, length and shape complement those of the width, length and shape of the lower edges of the sides 22 of the cover 12.

The box maybe produced from any suitable material, these including wood, hardboard, metal, plastics or a similar relatively rigid or semi-rigid material. Thus, the box can be assembled from separate pieces of material by well-known joining procedures, or could be cast from plastics or metal as a single piece or as separate pieces for subsequent assembly.

Figure 2:
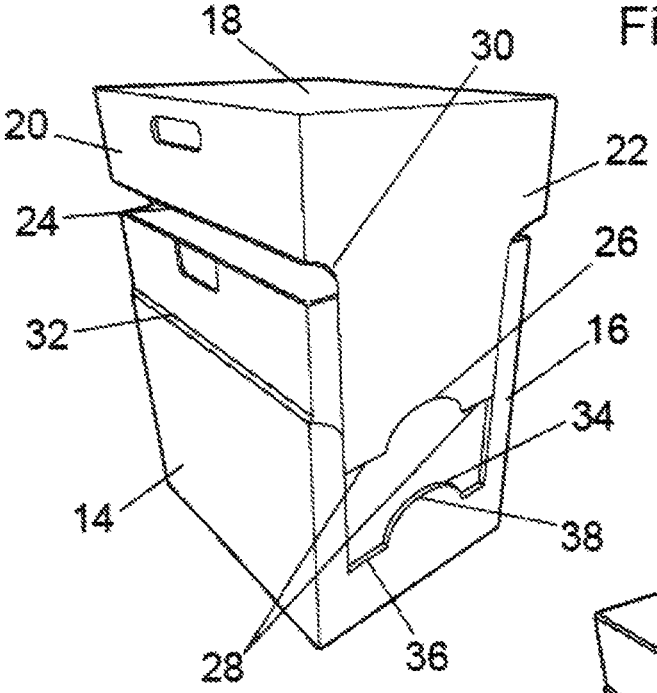
FIG. 2 is an isometric view of the box illustrated in FIG. 1 with the box cover partially removed.
Figure 3:
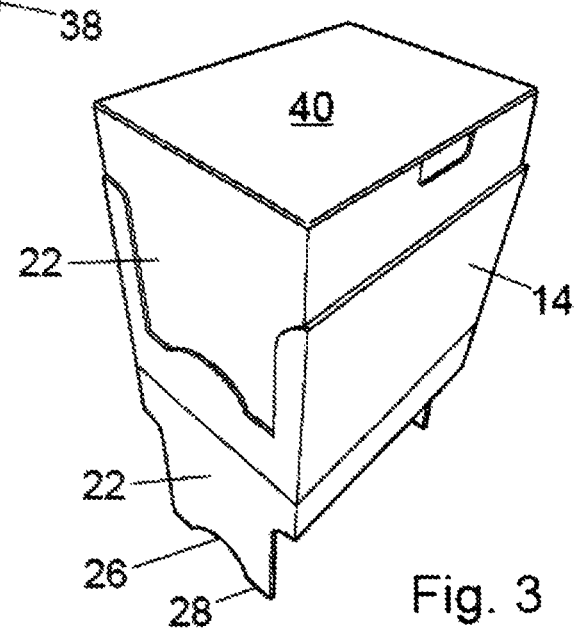
FIG. 3 is an isometric view of the illustrated box with its cover acting as a support.

The box is shown in its fully closed configuration in FIG. 1 and in its partially or fully open positions in FIGS. 2 and 3.

As will be seen from FIG. 3, the open upper surface of the box maybe closed by a second removable lid 40 which, in a preferred embodiment, comprises a suitably dimensioned sheet which rests on a ledge formed around the rim of the box upper surface.

In use, the box can act simply as a container for, for example, carrying work tools from one location to another, access to the box interior being simply achieved by removing the cover 12 and, if in place, the second lid 40. If required, the box can also serve as a work surface by replacing the cover 12. The height of this work surface is simply the height of the box.

Figure 4:
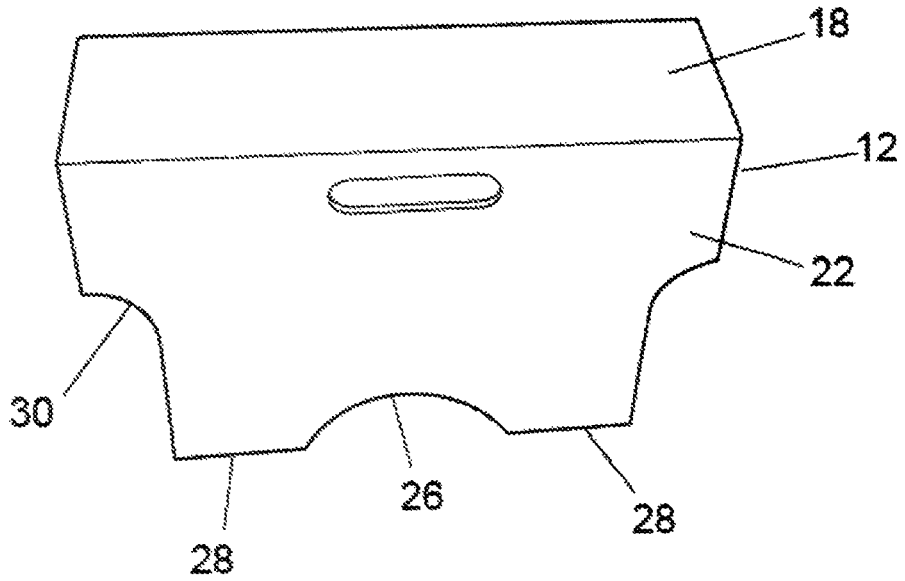
FIGS. 4 and 5 are isometric views of separate parts of the illustrated box when used as a stool and as a work top.

Additionally or alternatively, as shown in FIG. 4, the cover 12 can be removed from the box and used as a stool or table, the four legs of the stool or table being defined by the generally horizontal side sections 28 of each side wall 22, with the upper surface 18 of the lid defining a seat or work surface. The floor engaging side sections 28 act in the same way as the legs of a stool or table to provide firm and stable contact with a floor surface.

Figure 5:
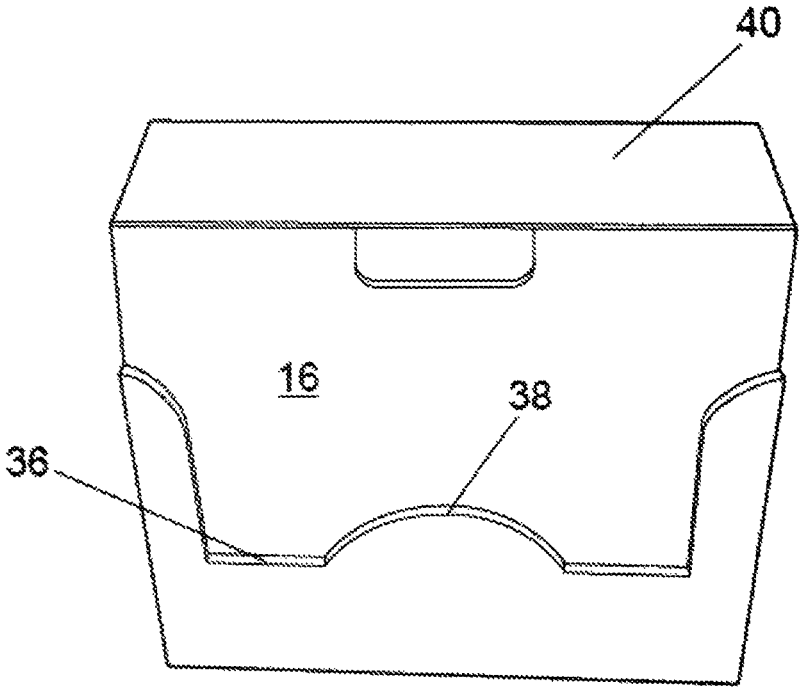

As will be seen from FIG. 5, with the lid 40 in place, the box can be used as a second working or support surface.

The box illustrated in FIGS. 6 to 9 is square in cross section rather than rectangular. Where appropriate, the same reference numerals have been adopted for this embodiment as were used for the previous embodiment.

Figure 6:
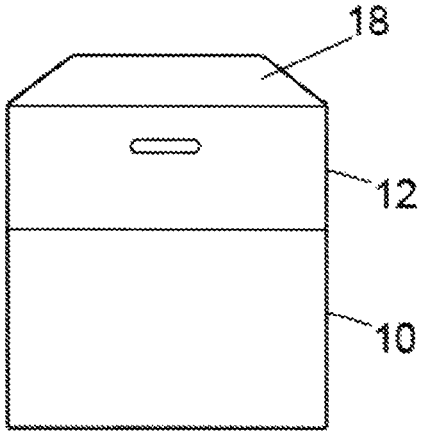
FIG. 6 is an isometric view from the front of a second box in accordance with the invention.
Figure 7:
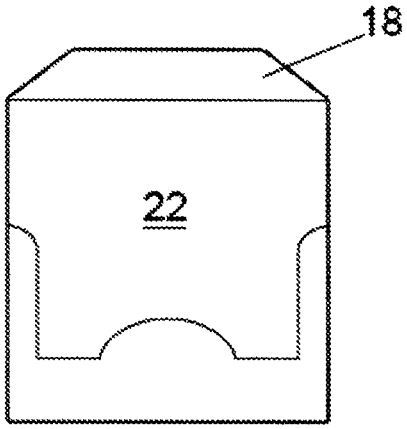
FIG. 7 is an isometric view from one side of the box illustrated in FIG. 7.
Figure 8:
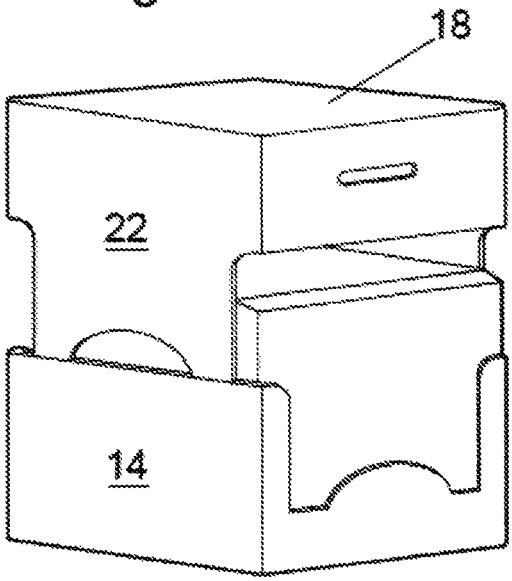
FIG. 8 is an isometric view of the box illustrated in FIGS. 7 and 8 with its cover in an elevated position.
Figure 9:
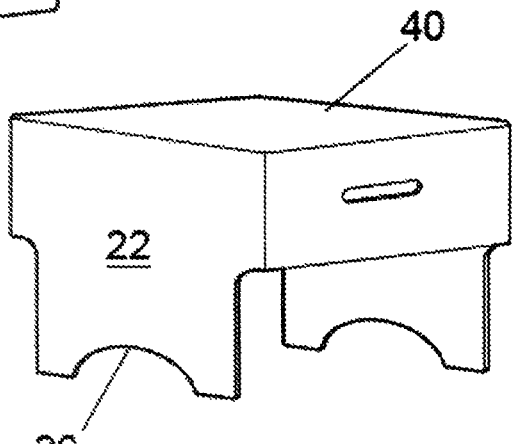
FIG. 9 is an isometric view of the upper section of the box illustrated in FIG. 8 separated from the box lower section when used as a stool and as a work top.

One advantage of this second embodiment is that, as shown in FIG. 8, the cover 12 can be removed from its position as shown in FIGS. 6 and 7, then turned through a right angle and relocated onto the box with its generally horizontal side sections 28 located on the ridges 32. In this way the height of the box is increased to provide a work or support surface at a further different height to that illustrated in FIG. 6

Whereas the illustrated boxes are described as being of rectangular or square section, the invention applies equally to boxes of circular or multi sided cross section.

In an embodiment, wheels may be attached to the box to assist movement between different locations. Also, a handle may be secured to one or more sides of the box for ease of transportation. Such a handle may be extendable. In this way the box could be used instead of a conventional suitcase when travelling with the added advantage that the cover 12 can be removed and employed as a stool and the lid 40 employed as a table or work surface when, for example, a delay occurs at, say, an airport.

The box could also include road wheels and act as a vehicle trailer.

In the above description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with storage containers have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is as "including, but not limited to." Further, the terms "first," "second," and similar indicators of sequence are to be construed as interchangeable unless the context clearly dictates otherwise. Moreover, unless the context requires otherwise, throughout the specification and claims which follow, relative terms such as "substantially" and "approximately" generally refer to a value that is within 5% of the stated value.

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its broadest sense, that is as meaning "and/or" unless the content clearly dictates otherwise.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A device, comprising:

a box, including:

a base;

a first pair of opposed sidewalls and a second pair of opposed sidewalls extending from the base, the first pair of opposed sidewalls each including a first ledge and the second pair of opposed sidewalls each including a second ledge with the first ledges extending from the first pair of opposed sidewalls at a first distance relative to the base and the second ledges extending from the second pair of opposed sidewalls at a second distance relative to the base less than the first distance, both the first distance and the second distance being less than a height of the first pair of opposed sidewalls and a height of the second pair of opposed sidewalls;

a lid attached to the first pair of opposed sidewalls or the second pair of opposed sidewalls; and a cover configured to be located on the box, the cover having an upper surface coupled to a first pair of sides and a second pair of sides, a length of the first pair of sides being less than a length of the second pair of sides, the second pair of sides each having a lower edge with a first portion, a second portion, and a third portion, the first portion and the third portion being horizontal and the second portion being curvilinear and positioned between the first portion and the third portion, wherein during operation, the cover is removed from the box and employed as a support surface with the lower edges of the second pair of sides arranged as feet of the support surface.

2. The device of claim 1 wherein the second ledges of the second pair of opposed sidewalls of the box each include a curved central section.

3. The device of claim 1 wherein the second pair of sides of the cover have a first width proximate the upper surface of the cover and a second width proximate the lower edge of the cover that is less than the first width.

4. A box, comprising:

a trunk, including:

a base;

a plurality of sidewalls coupled to the base including a first pair of opposed sidewalls and a second pair of opposed sidewalls coupled to the first pair of opposed sidewalls; and a plurality of ledges in the plurality of sidewalls, the ledges in the first pair of opposed sidewalls located at a first distance relative to the base and the ledges in the second pair of opposed sidewalls located at a second distance relative to the base less than the first distance, both the first distance and the second distance being less than a height of the trunk; and a cover configured to be coupled to located on the trunk, including:

an upper surface; and a plurality of sides coupled to the upper surface of the cover including a first pair of sides and a second pair of sides coupled to the first pair of sides, the first pair of sides having a first length and the second pair of sides having a second length greater than the first length, the second pair of sides each having a lower edge with a first portion, a second portion, and a third portion, the first portion and the third portion being horizontal and the second portion being curvilinear and positioned between the first portion and the third portion, wherein, during operation, the cover is removed from the trunk and employed as a support surface with the second pair of sides of the plurality of sides of the cover arranged as feet of the support surface configured to engage a ground surface.

5. The box of claim 4 wherein the trunk and the cover both have a square or rectangular cross section.

6. The box of claim 4 further comprising:

a lid positioned below the cover and extending over the trunk.

7. The box of claim 4 wherein the second portion of the lower edge of each of the second pair of sides of the cover is located centrally relative to the lower edge.

8. The box of claim 4 wherein the second pair of sides of the cover have a first width proximate the upper surface of the cover and a second width proximate the lower edge that is less than the first width.

9. The box of claim 8 wherein each of the second pair of sides have an interface between the first width and the second width that is curvilinear.

10. The box of claim 4 wherein the ledges in the second pair of opposed sidewalls of the trunk include a curved central section.

* * * * *